United States Patent [19]

Parezo

[11] 4,265,064

[45] May 5, 1981

[54] BASEMENT WATERPROOFING SYSTEM

[76] Inventor: Allen Parezo, 16112 Laurel Ridge Dr., Laurel, Md. 20810

[21] Appl. No.: 43,370

[22] Filed: May 29, 1979

[51] Int. Cl.[3] ..... E02D 27/00

[52] U.S. Cl. ..... 52/169.5; 52/169.14

[58] Field of Search ..... 52/169.5, 169.14, 241, 52/242

[56] References Cited

U.S. PATENT DOCUMENTS

| | | | |
|---|---|---|---|
| 2,717,513 | 9/1955 | Smart | 52/169.5 |
| 3,304,672 | 2/1967 | Bakke | 52/169.5 |
| 3,344,569 | 10/1967 | Cotten | 52/169.5 |
| 3,633,327 | 1/1972 | Klingensmith | 52/241 |
| 3,656,268 | 4/1972 | Marati | 52/169.5 |
| 3,685,227 | 8/1972 | Grisard | 52/242 |
| 3,850,193 | 11/1974 | Guzzo | 52/169.5 |
| 3,852,925 | 12/1974 | Guzzo | 52/169.5 |
| 3,975,467 | 8/1976 | Beck | 52/169.5 |
| 4,075,800 | 2/1978 | Mollick | 52/169.5 |
| 4,185,429 | 1/1980 | Mendola | 52/169.5 |

*Primary Examiner*—Price C. Faw, Jr.
*Assistant Examiner*—Henry E. Raduazo
*Attorney, Agent, or Firm*—Dennison, Meserole, Pollack & Scheiner

[57] ABSTRACT

A system, for new or old construction, involving the installation of channels of water impermeable material along the juncture between the floor slab and the adjoining exterior walls, immediately beneath and substantially flush with the interior wall paneling components used to finish the interior of the exterior walls. The channels provide for the direct collection and removal of seepage water or the like coming through the exterior walls.

14 Claims, 8 Drawing Figures

BASEMENT WATERPROOFING SYSTEM

BACKGROUND OF THE INVENTION

The invention herein relates to a waterproofing system, or more particularly to a drainage system specifically adapted for installation within basements, or other subsurface rooms, wherein water seepage is a present or anticipated problem. The system is uniquely adapted for use with and accommodation of the interior paneling, of all types, used to finish the interior of exterior walls, whether this involve new or old construction.

A serious and almost universal problem which arises in connection with buildings incorporating basements or similar subsurface areas, is the substantial difficulties encountered in preventing inward seepage of water, particularly following periods of heavy precipitation. This seepage frequently accumulates at the floor line and, if not controlled, can cause substantial damage to both the interior walls and to the contents of the area.

Many solutions have been proposed either to prevent the seepage or to control the interior water generated therefrom. Such solutions have included extensive exterior ground excavations to expose the walls for the coating thereof or the installation of drainage tiles and the like. Other proposed solutions involve working with the interior of the wall and/or floor. Such proposed solutions normally involve a removal, if not a complete destruction of, any interior wall paneling. Likewise, efforts to solve the drainage problems from the interior of the building frequently entail an actual breaking up of the floor for the installation of drainage tile, an expedient now actually forbidden in at least some jurisdictions.

Finally, it has heretofore been proposed to control water seepage or drainage by the provision of channel-like units or conduits about the base of the exterior walls, either above or below floor level. Known examples of such drainage accommodating systems will be noted in the following patents:

U.S. Pat. No. 2,717,513; Smart; Issued Sept. 13, 1955
U.S. Pat. No. 3,304,672; Bakke; Issued Feb. 21, 1967
U.S. Pat. No. 3,344,569; Cotten; Issued Oct. 3, 1967
U.S. Pat. No. 3,656,268; Murati; Issued Apr. 18, 1972
U.S. Pat. No. 3,852,925; Gazzo; Issued Dec. 10, 1974
U.S. Pat. No. 3,975,467; Beck; Issued Aug. 17, 1976
U.S. Pat. No. 4,075,800; Molick; Issued Feb. 28, 1978

The patents to Smart, Bakke, Cotten, Beck and Molick (FIG. 5) are considered of particular interest in illustrating the known state-of-the-art with regard to the particular form of drainage system wherein drainage channels are provided on the surface of the floor at the base of the exterior wall, the specific environment of the present invention. However, the known systems, as exemplified by these patents, suggest no procedure for installation wherein the exterior wall is provided with a finished or paneled interior surface. Similarly, the known systems are rather limited in application, normally requiring that the inner surface of the exterior wall be exposed for direct engagement of the drainage system therewith, and with no provision being made for the adaptation of the drainage system to interior wall finishing systems of substantially any type, including sill mounted stud walls.

SUMMARY OF THE INVENTION

It is a primary object of the present invention to provide a drainage system, for above floor installation at the juncture between the floor and an exterior wall, which is particularly adapted for use with and the accommodation of interior wall finishing systems, normally stud or furring strip supported paneling, including plaster board and the like. The system is equally capable of use as an addition to existing construction, or as a component, structural or otherwise, in new construction.

Basically, the system includes an elongated drainage channel of appropriate water impervious material, such as polyvinylchloride (PVC), or the like. This channel includes a vertical front panel, a top panel integral with the front panel below the upper edge thereof and projecting rearwardly therefrom, and a rear panel integral with the rear edge of the top panel and depending vertically therefrom to a point generally coplanar with the bottom edge of the front panel. The bottom edge of the front panel in turn includes a downwardly directed groove defined therein for the reception of a combined sealer and adhesive. The front panel can be provided with a decorative face thereon or a separately attached trim board. Further, appropriate supports can be provided depending from the top panel at selected points along the length thereof, such supports providing no substantial interference with the flow of water along the length of the channel.

In environments wherein an interior wall paneling system exists, installation of the channel is effected by severing the lower portion of the panel system, along the full or desired length thereof, at a height equal to or slightly greater than the height of the top panel. The severed portion of the paneling system is then removed and the drainage channel introduced within the space provided. The depth of the drainage channel, if necessary, can be adjusted by a longitudinal severing of the top panel. This in turn may entail a removal of the rear panel. It is intended that the finished introduction of the channel position the rear surface of the front panel in line with or immediately against the outer surface of the wall paneling system. The installation is completed by directly sealing and adhesively securing the lower edge of the front panel of the channel to the floor by means of an appropriate combined sealant and adhesive provided within the groove defined along the lower edge of the front panel. Two commercially available forms of such material are STYRO-BOND ADHESIVE and WALL BOND PANELING ADHESIVE, manufactured by 3 C Company, Division of Continental Chemical & Coatings Corp., Woburn, MA. 01801. Finally, if so desired, the upper portion of the front panel of the channel can be directly nailed to the paneling system, preferably the furring strips or studding.

In those instances wherein a stud formed interior wall system is involved, a supporting sill can be provided directly on the top panel of the channel member and the paneling wall constructed thereon. Incidentally, it is to be appreciated that when reference is made to an interior wall paneling system or means, this is intended to encompass all conventional wall finishing materials, including decorative wood panels, plasterboard sheets, dry and wet plaster walls, and the like, whether stud or furring supported, or directly adhered, as by adhesive, to the interior face of the exterior wall.

These features, objects and advantages, together with others, will become more apparent from the detailed description of the construction and manner of use as fully hereinafter described and claimed.

DESCRIPTION OF PREFERRED EMBODIMENTS

Figure 1:
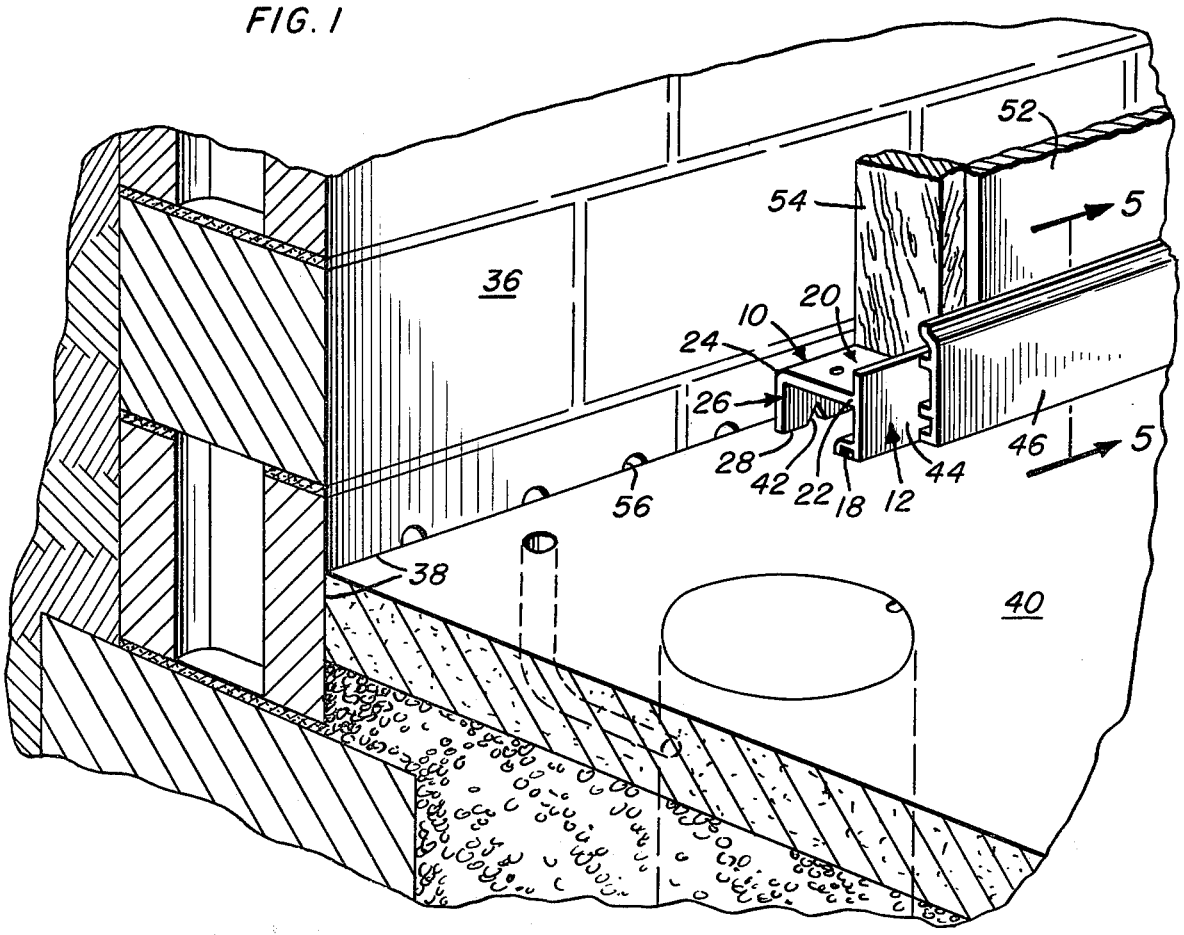
FIG. 1 is a perspective illustration of the system of the present invention installed in conjunction with a preexisting stud interior paneling wall.
Figure 5:
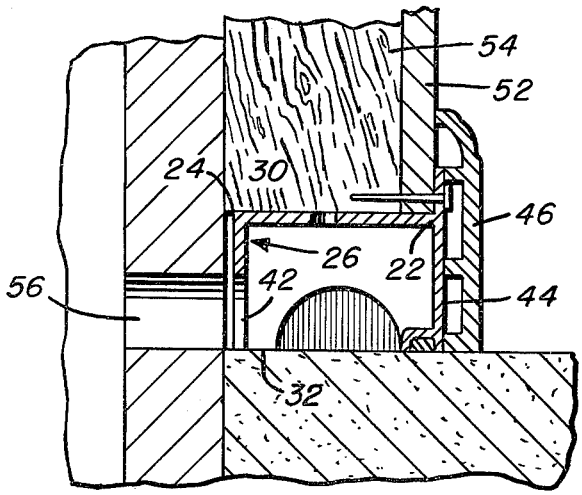
FIG. 5 is a cross-sectional view taken substantially on a plane passing along line 5—5 in FIG. 1.
Figure 3:
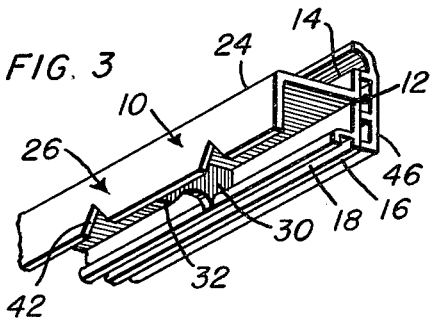
FIG. 3 is a bottom perspective view of the channel member of the drainage system of the present invention.

Referring now more specifically to the drawings, reference 10 is used to designate the basic drainage channel or channel defining member utilized in the drainage system of the present invention. This channel 10 is integrally formed, normally in extruded lengths, of an appropriate substantially rigid water impermeable material, preferably a plastic such as polyvinylchloride (PVC).

In construction, the channel 10 includes a vertical front panel 12 having parallel upper and lower edges 14 and 16. The lower edge is rearwardly enlarged so as to define a full length downwardly directed groove 18 specifically adapted to receive a combined sealant and adhesive, as shall be described in more detail subsequently.

A top panel 20 projects horizontally rearward from the front panel 12 and has the forward edge thereof integrally formed, as at 22, with the rear face of the front panel 12 on a line parallel to and spaced below the upper edge 14. The rear edge of the top panel 20 is integrally formed, as at 24, with the top edge of a depending vertical rear panel 26, the lower edge 28 of which is substantially coplanar with the lower edge 16 of the front panel 12. In a preferred form, the height of the front panel 12 will be approximately $2\frac{1}{2}$ inches, and the height from the horizontal plane of the lower edges 16 and 28 to the top surface of the top panel 20 will be approximately $1\frac{3}{4}$ inches. The depth of the channel, between the front and rear panels 12 and 26, will be approximately $2\frac{1}{2}$ inches.

If deemed desirable, the channel 10 can be internally strengthened and rigidified by spaced cross-webs 30 intimately engaged with the inner surfaces of the front, rear and top panels and including a lower edge portion 32 coplanar with the lower edges 16 and 28 of the front and rear panels. These webs 30, so as to allow for the unimpeded flow of water along the channel, will include appropriate openings therethrough.

Inasmuch as the channel is specifically intended to receive and accommodate water seepage received from the adjacent wall 36, or through the juncture 38 between the wall 36 and floor 40, the rear panel 26 will include a series of spaced openings 42 therein extending upwardly from the lower edge 28.

The front face 44 of the front panel, which may or may not be exposed in the installed position, can have a decorative surface thereon. Alternatively, a preformed trim board 46 can be bonded thereto, either prior to or subsequent to installation of the channel.

The channel construction described supra, while not specifically limited thereto, is particularly intended for use in the construction of drainage systems wherein interior wall paneling, of any conventional type, is associated with the exterior wall 36. The channel construction is equally adapted for installation in a preconstructed wall system, or as a component in new construction.

When installation of the drainage system of the present invention is desired in a preconstructed wall system, a sequence of steps enables such an installation without a complete removal or destruction of preexisting internal wall paneling, as heretofore required. The installation, to the contrary, involves a sequence of steps which require only a removal of the lower edge portion of any preinstalled interior wall paneling sufficient so as to accommodate the drainage channel, with the installed channel being completely hidden and providing a finished appearance to the wall.

Figure 4:
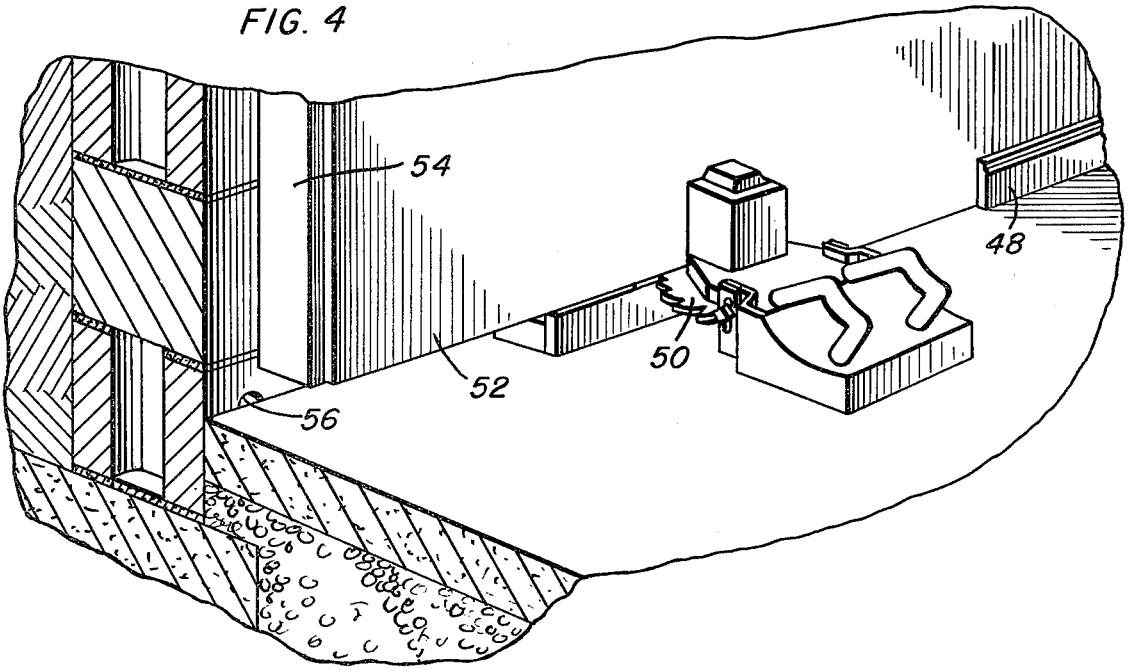
FIG. 4 is a perspective illustration of the steps involved in installing the drainage system in an existing paneled construction.

The installation of the drainage system in a preconstructed wall assembly will be best appreciated from FIG. 4. Basically, any trim or baseboard 48 is removed and, utilizing an appropriate horizontally mounted and guided saw 50, a horizontal cut is made through both the interior paneling 52 and any support structure 54, such as studding or furring. This cut will normally be just above any sill which might be present. After the cut is made, the severed material is removed, leaving a cavity of a height slightly greater than the height of the top panel 20 of the channel 10, and preferably less than the height of the top edge 14 of the front panel 12, thereby enabling an introduction of the channel 10 to a point whereby the rear surface of the front panel 12 engages against the outer or interior face of the paneling 52. To encourage and control the seepage or drainage of the water from the exterior wall 36, normally constructed of hollow-core concrete block, a plurality of drain or weep holes 56 can be drilled into the wall prior to introduction of the channel 10 into the saw-formed cavity.

When the channel 10 is being finally introduced or positioned, an appropriate bead of a combined sealant and adhesive is provided within the downwardly directed lower edge groove on the front panel 12 so as to effect a positive seal and adhesive attachment to the floor. Further stabilization of the channel may be effected by the use of driven fasteners extending through the upper portion of the front channel panel 12 into the interior wall paneling, or more particularly the studding or firring strips 54 therefor. If deemed desirable, a bead of sealant and adhesive can also be provided exteriorly along the lower edge 16 of the front panel 12. When installed in this manner, a completely sealed drainage system is provided with a finished appearance, which appearance may be enhanced by the incorporation of the trim panel 46 mounted over the front face 44 of the front panel 12 either prior or subsequent to the installation of the channel.

The drainage or weep holes 56, in directing and controlling the seepage of water, will also enable a traveling of the water both into and out of the blocks. This encourages a more rapid removal of any water present within the channels in that, rather than requiring the travel of water to the sump outlet, the water can be directly bled off into those areas wherein there is very little or no external water build up. The water, in any event, is specifically precluded from movement into the room area by the sealed front panel.

It is to be appreciated that substantial care must be taken with regard to installing the drainage system in old construction. For example, in severing and removing the lower portion of the interior wall paneling, interior pipes, wiring, and the like must be avoided. In addition, if water seepage has already occurred, the water must be removed and the floor surface cleaned and dried so as to insure a proper seal therewith. If necessary, a clear floor sealer and hardener can also be applied to seal the pores in the concrete floor. Other factors which must be considered involve the particular nature of the support system for the interior wall paneling, that is whether floor supported studs are involved, or whether wall mounted furring strips are utilized. Both of these situations will be discussed presently in conjunction with FIGS. 1 and 2 in particular.

The particular nature of the material from which the channel is to be formed is such so as to readily lend itself to cutting, adhesive bonding, heat welding, and the like, whereby the channel can be provided with extended lengths, mitered corner construction, and such modification as may be required to accommodate obstructions. Appropriate alignment tabs may also be provided on one or both ends of preformed lengths of channels. Finally, it will be appreciated that appropriate sump or water collection means will be required, in communication with the drainage channel or channels, for the removal of water collecting therein.

With particular reference to FIG. 1, the drainage system has been illustrated as installed in a preconstructed stud supported interior wall paneling system. In such a situation, the channel 10 will specifically include the reinforcing cross-webs 30. Further, the installation of the channel will be in relatively small segments whereby the integrity of the wall can be maintained during the installation with the support of each wall section being transferred to the channel 10 which, assuming the dimensions as set forth supra, closely conforms to that of a conventional 2×3 sill. In those instances wherein a 2×3 support system is involved, the rear leg or panel 26 of the channel 10 will be positioned closely against the interior face of the exterior wall 36, and care should be taken so as to generally align the rear panel openings 42 with the weep holes 56 formed in the wall 36. In those instances wherein a 2×4 support system is involved, a space will be provided between the interior face of the exterior wall and the rear panel 26. Thereby, an alignment of the rear panel openings 42 and the weep holes 56 is not as critical. In instances of severe leakage through the exterior wall 36, particularly above the floor level, holes can be provided through the top panel 20 at spaced points therealong to insure a passage of the water into the channel 10.

Figure 2:
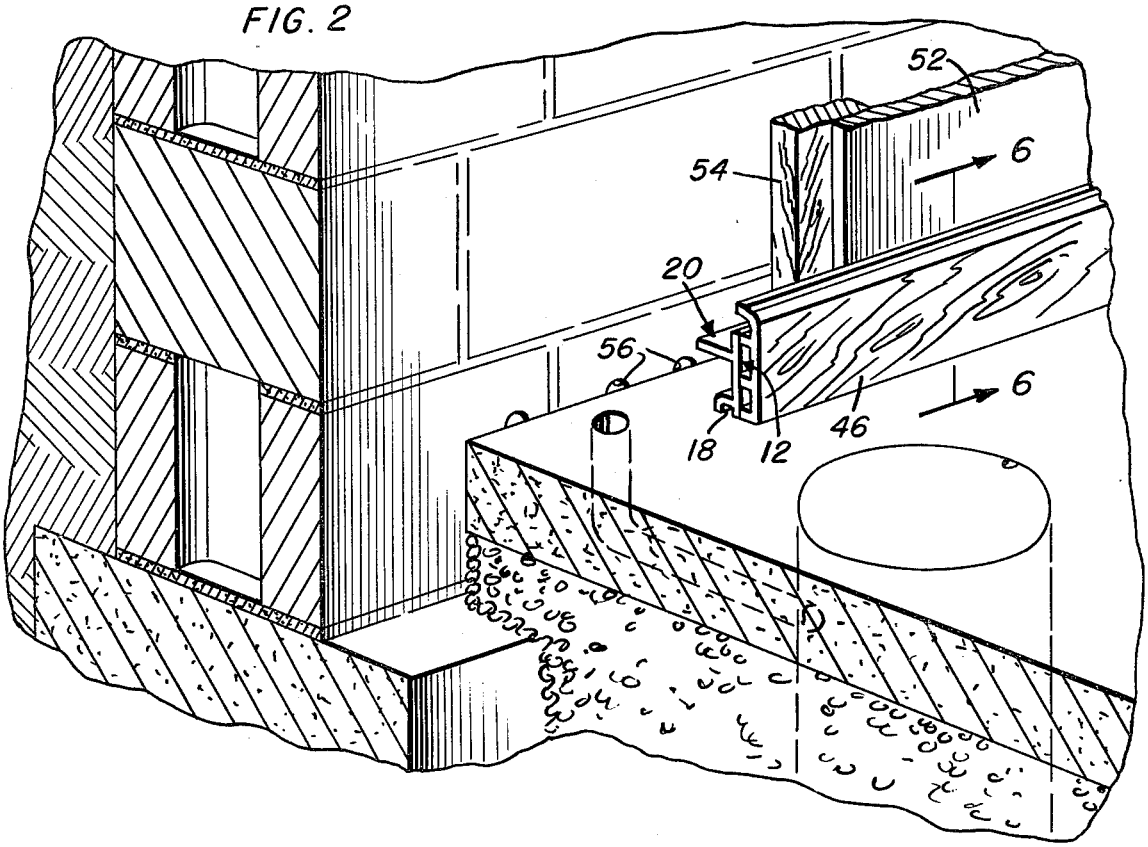
FIG. 2 is a perspective illustration of a system of the present invention installed in conjunction with a preexisting furring strip supported paneling system.

FIG. 2 illustrates installation of the drainage system within a preformed wall system wherein the interior wall paneling is supported by furring strips. With such a construction, the support of the interior wall paneling system is not as critical in that the support is effected directly from the exterior wall, rather than from the floor itself. While a narrow channel can be specifically formed so as to accommodate the relatively narrower space provided by the furring strip supports, the present invention also contemplates the use of the same basic channel 10. This is effected by a longitudinal severing of the top panel 20, either by sawing or by breaking along a line of weakness, to remove the rear panel 26 and/or the rear portion of the top panel 20 so as to reduce the depth of the channel sufficient for accommodation within the relatively narrower depth of the cavity formed by a removal of the lower portions of the furring strips and the paneling supported thereby. In extreme circumstances, the entire top panel can be removed. With such an arrangement, it will be appreciated that the internal water accommodating conduit will actually be formed by the front panel 12, any retained portion of the top panel 20, and the interior face of the exterior wall 36. The stabilization of the retained portion of the top panel 20 can be, if necessary, maintained by the remaining unsevered portions of the cross-webs 30. In regard to such cross-webs 30, it is to be appreciated that the passages or openings 34 defined therein are such so as to accommodate the flow of water therethrough, even upon a partial removal of the rear portion thereof. In this construction, as in the previously described construction, the interior wall paneling will extend below the upper edge 14 of the front panel to a level at or slightly above the top panel 20, thereby providing a finished baseboard appearance to the paneling, either by the front panel 12 itself, or an appropriate trim strip mounted thereon.

Figure 7:
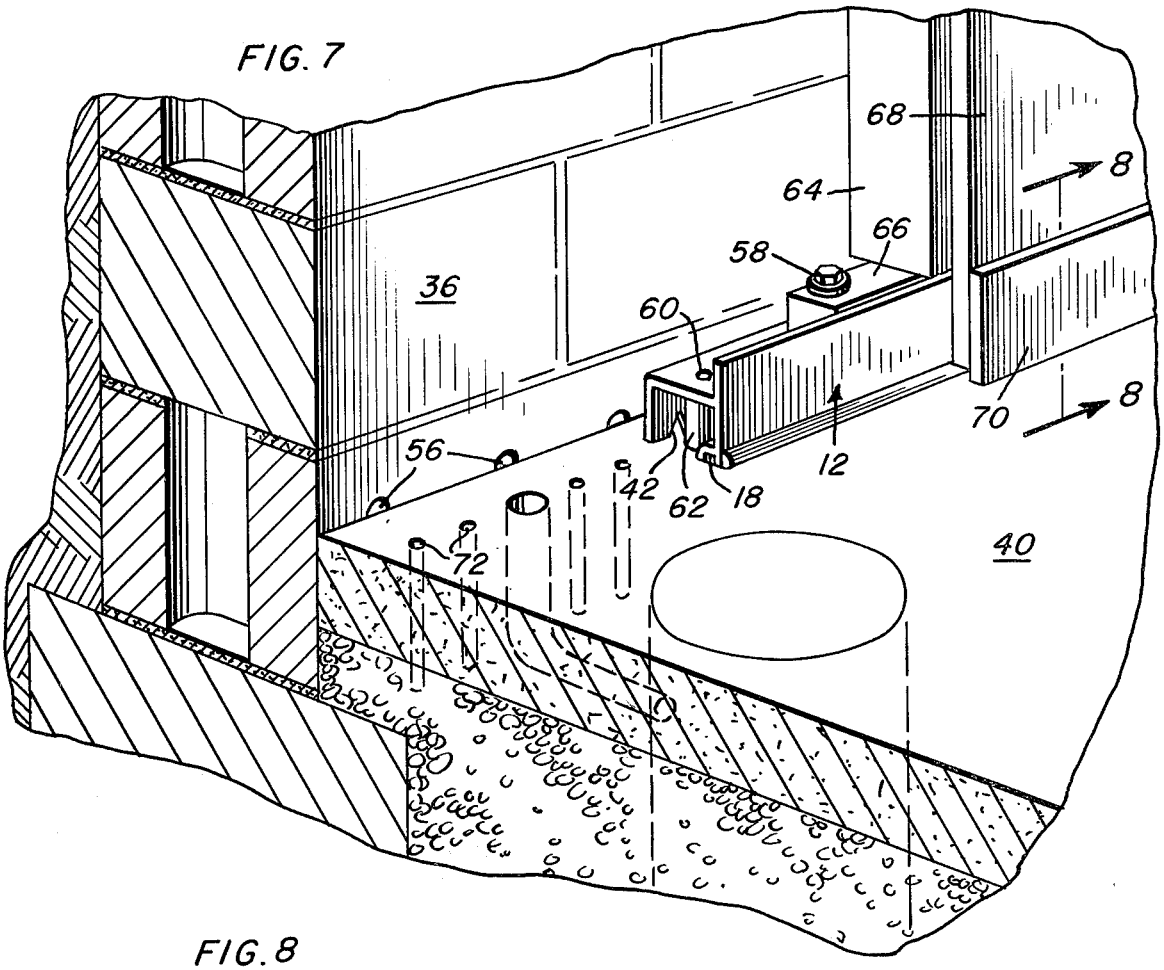
FIG. 7 is a perspective illustration of the drainage system as an integral part of new construction.
Figure 8:
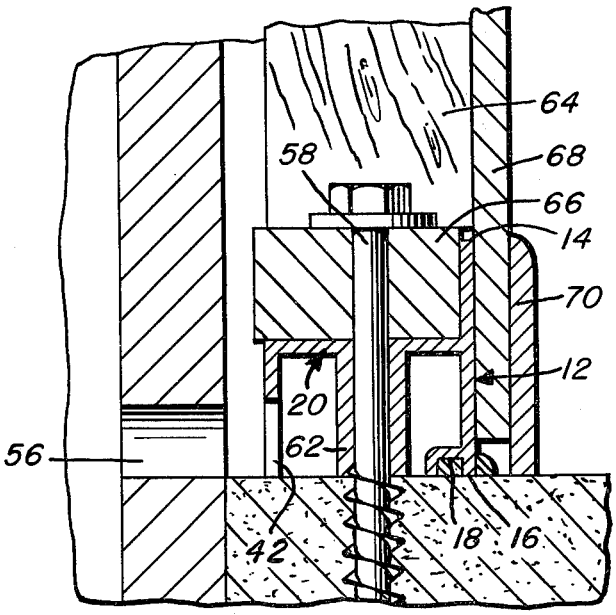
FIG. 8 is a cross-sectional view taken substantially on a plane passing along line 8—8 in FIG. 7 illustrating a modified form of support.
Figure 6:
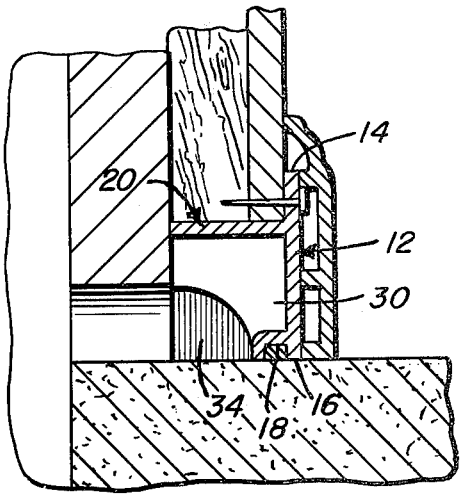
FIG. 6 is a cross-sectional view taken substantially on a plane passing along line 6—6 in FIG. 2.

FIGS. 7 and 8 illustrate one manner of incorporating the drainage system of the invention in new construction. In doing so, after the drilling of the weep holes 56 through the interior face of the exterior wall 36, the channel or channels 10 are positioned on the floor 40 parallel to, and if so desired slightly spaced inwardly from, the wall 36 with the lower edge of the front panel 12 bonded to the floor. Additional stability can be provided by extending driven fasteners 58 through preformed holes 60 provided in the top panel 20. Inasmuch as the channel 10, in this environment, will support the weight of the stud wall thereabove, appropriate internal supports will be required. While the supports can take the form of the previously described cross-webs 30, inasmuch as floor engaged fasteners 58 will be utilized, it is preferred that the supports be in the nature of tubular legs 62 aligned with the top panel apertures 60 for a reception of the driven fasteners 58 therethrough. Additional supports 62, or 30, can also be provided as required along the length of the channel 10.

If desired, the lower ends of the studs 64 can be seated directly on the top panel 20. However, it would be preferred that an appropriate sill 66 be utilized. This sill 66 will directly overlie and extend along the top panel 20, being either adhesively fastened thereto or secured by extended driven fasteners 58 which will pass through the sill 66, the top panel aperture 60, the tubular support 62, and into the underlying floor slab. Next, the appropriate facing sheets or paneling 68 will be secured to the studs 64 with this paneling normally overlying the front face of the front channel panel 12 and terminating at a point slightly above floor level. The installation will be completed by the mounting of an appropriate trim strip 70.

In new construction in particular, and prior to a positioning of the channels 10, it may also be desirable to provide a series of holes 72 drilled through the floor slab to relieve any tendency for the build up of hydrostatic pressure beneath the slab. In this manner, any excess pressure build up will be directed into the channel of the drainage system for discharge either through the weep holes or into the sump.

It is to be appreciated that the drainage system of the present invention, and in particular the drainage channel 10, can be adapted so as to accommodate a wide range of interior wall paneling systems of both old and new construction, with the installed drainage system being completely effective in accommodating surface water and subterranean water seepage so as to protect not only the interior wall paneling systems, but also the contents of the room. Installation of the drainage system, while unique, is relatively straightforward and economical, and when installed, is completely hidden or disguised beneath a conventional appearing baseboard or trim strip.

Incidentally, it should be appreciated that while the interior wall system was referred to as a wall paneling system, this terminology is intended to encompass any conventionally used interior wall finishing material, such as wood panels, dry wall or plasterboard sheets, and the like.

The foregoing is illustrative of the principles of the invention. As modifications and different manners of use may occur to those skilled in the art, it is to be appreciated that such modifications and different manners of use may be resorted to, within the scope of the invention as claimed.

I claim:

1. For use in a waterproofing system for a subsurface room, a drainage channel, said channel including an elongated substantially vertical planar front panel, said front panel having upper and lower edges, and front and rear faces, an elongated substantially horizontal planar top panel, said top panel having a first front edge integral with the rear face of said front panel generally parallel and in spaced relation to the upper and lower edges of said front panel, said top panel having a second rear edge generally parallel to said front edge, a planar rear panel integral with and projecting solely vertically downwardly from the rear edge of said top panel, fluid passage means defined through said rear panel, an integral downwardly directed sealer receiving groove formed along the lower edge of said front panel, and depending support means integral with the top panel between the front and rear panels.

2. The construction of claim 1 including decorative means associated with the front face of said front panel.

3. The construction of claim 2 wherein said decorative means comprises an elongated trim board fixed to said front face.

4. For use in a waterproofing system for a subsurface room, a drainage channel, said channel including an elongated substantially vertical front panel, said front panel having upper and lower edges, and front and rear faces, an elongated substantially horizontal top panel, said top panel having a first front edge integral with the rear face of said front panel generally parallel and in spaced relation to the upper edge of said front panel, said top panel having a second rear edge generally parallel to said front edge, an integral downwardly directed sealer receiving groove formed along the lower edge of said front panel, support means engaged with and depending from said top panel rearward of the front edge thereof, said support means comprising a rear panel integral with and depending vertically from the rear edge of said top panel, and fluid passage means defined through said rear panel, said support means further comprising vertical components fixed to said top panel and depending therefrom at spaced points therealong, said vertical components being oriented between the front and rear panels.

5. The construction of claim 4 including a series of fastener receiving openings defined through said top panel.

6. The construction of claim 5 wherein selected ones of said support components include vertical passages therethrough aligned with said fastener receiving openings.

7. In a building, an exterior building wall having an interior surface, an interior floor forming a juncture with the interior surface of said building wall, interior wall paneling means paralleling said interior surface and including an interior face, and a drainage system positioned on said floor beneath said interior wall paneling means, said drainage system including a water impermeable front panel, said front panel generally paralleling the interior face of the wall paneling means immediately adjacent thereto, said front panel having upper and lower edges, means sealing the lower edge of said front panel to said floor, a horizontal top panel having one edge integral with the front panel below the upper edge thereof and projecting rearwardly therefrom, said top panel and said front panel defining a water channel area beneath said interior wall paneling means, water collection means communicated with said water channel area to collect water therefrom, a vertical rear panel integral with said top panel and depending therefrom to approximately the plane of the lower edge of the front panel, said rear panel having water passing openings therethrough, a series of supports depending from said top panel at spaced points therealong, each support being located between said front and rear panel and extending to approximately the plane of the lower edge of the front panel, and a sill member engaged on and extending along said top panel, said sill member constituting a direct support for the interior wall paneling means.

8. The construction of claim 7 wherein the interior face of said wall paneling means overlies said front panel and extends below the upper edge thereof, and trim means projecting upwardly from said floor into overlying relation to the interior face of said wall paneling means.

9. In the construction of a floor mounted interior wall paneling system, a drainage channel of water impermeable material positioned on and along the floor, said channel comprising a vertical front panel having upper and lower edges, a horizontal top panel integral with said front panel below the upper edge thereof, said top panel projecting rearwardly from said front panel and terminating in a rear edge, and a vertical rear panel integral with the rear edge of the top panel and depending therefrom to a lower edge generally coplanar with the lower edge of said front panel, an elongated horizontal sill member positioned on said top panel along the length thereof, a series of vertical studs supported on said sill member at spaced points therealong, and facing panel means engaged with said studs parallel to and closely adjacent said front panel, said rear panel having a series of water passing openings therethrough, and means sealing the lower edge of said front panel to the floor to produce water passage therethrough.

10. The construction of claim 9 including vertical support means integral with the top panel between the front and rear panels, said vertical support means depending from the top panel to a point generally coplanar with the lower edges of the front and rear panels.

11. In the construction of a floor mounted interior wall paneling system, a drainage channel of water impermeable material positionable on and along the floor, said channel comprising a vertical front panel having upper and lower edges, a horizontal top panel integral with said front panel below the upper edge and above the lower edge thereof, said top panel projecting rearwardly from said front panel and terminating in a rear edge, and a vertical rear panel integral with the rear edge of the top panel and depending solely downwardly therefrom to a lower edge generally coplanar with the lower edge of said front panel, said top panel being adapted to receive an elongated horizontal sill member positioned thereon and along the length thereof for receiving series of vertical studs at spaced points therealong to, in turn, mount facing panel means parallel to and closely adjacent said front panel, said rear panel having a series of water passing openings therethrough, and means for sealing the lower edge of said front panel to the floor to preclude water passage therethrough.

12. The construction of claim 11 wherein said rear panel projects solely vertically downward from the rear edge of the top panel.

13. The construction of claim 12 wherein the lower edge of the front panel, in spaced relation below the top panel, is rearwardly enlarged and defines a downwardly directed sealant receiving groove.

14. The construction of claim 11 including vertical support means integral with the top panel between the front and rear panels, said vertical support means depending from the top panel to a point generally coplanar with the lower edges of the front and rear panels.

* * * * *